US008561685B2

(12) United States Patent
Rodgers

(10) Patent No.: US 8,561,685 B2
(45) Date of Patent: Oct. 22, 2013

(54) MOBILE HYDRAULIC WORKOVER RIG

(75) Inventor: Troy A. Rodgers, Tomball, TX (US)

(73) Assignee: Rodgers Technology, LLC, Chickasha, OK (US)

( * ) Notice: Subject to any disclaimer, the term of this patent is extended or adjusted under 35 U.S.C. 154(b) by 0 days.

(21) Appl. No.: 13/451,330

(22) Filed: Apr. 19, 2012

(65) Prior Publication Data

US 2013/0020067 A1 Jan. 24, 2013

Related U.S. Application Data

(63) Continuation of application No. 12/370,393, filed on Feb. 12, 2009, now abandoned.

(60) Provisional application No. 61/126,011, filed on Apr. 30, 2008.

(51) Int. Cl.
*E21B 19/18* (2006.01)

(52) U.S. Cl.
USPC ..... 166/77.53; 166/77.4; 166/380; 166/85.1

(58) Field of Classification Search
USPC ..... 166/77.53, 77.4, 77.52, 378, 379, 380, 166/85.1; 414/22.51
See application file for complete search history.

(56) References Cited

U.S. PATENT DOCUMENTS 3,158,213 A * 11/1964 O'Neill et al. ..... 175/85
4,208,158 A * 6/1980 Davies et al. ..... 414/22.68

OTHER PUBLICATIONS

International Search Report and Written Opinion (PCT/US2009/042381); Dec. 20, 2010.

* cited by examiner

*Primary Examiner* — Cathleen Hutchins
(74) *Attorney, Agent, or Firm* — Dunlap Codding, P.C.

(57) ABSTRACT

A hydraulic workover rig including a base structure, a derrick extending from the base structure, a hydraulic lift cylinder connected to the upper end of the derrick, a lower slip assembly connected to the base structure, an upper slip assembly, and at least two snub cylinders connected to the base and the upper slip assembly. A distal end of a piston rod of the lift cylinder is connectable to a pipe string extendable through the upper and lower slip assemblies such that both a lifting force and a snubbing force may be applied simultaneously to the pipe string.

2 Claims, 23 Drawing Sheets

MOBILE HYDRAULIC WORKOVER RIG

CROSS REFERENCE TO RELATED APPLICATION

This application is a continuation of U.S. patent application Ser. No. 12/370,393, filed Feb. 12, 2009 now abandoned, which claims priority to Provisional Patent Application No. 61/126,011, filed Apr. 30, 2008, both of which are hereby incorporated herein by reference in their entirety.

BACKGROUND OF THE INVENTION

Field of the Invention

The following relates to workover and drilling rigs, and more particularly relates to a novel and improved method and apparatus adaptable for use in the servicing and treatment of oil or gas wells.

An important consideration in the design and construction of workover rigs in the servicing and treatment of wells is the ability to move efficiently between wells which are located a short distance from one another, such as, for example, wells in a cluster or in one or more rows in directional drilling operations.

In the past, workover rigs have been so constructed and arranged that the derrick and its substructure must be disassembled to move between each well. It has also been proposed to utilize skids without disassembling the structure but has required some disassembly of the derrick and is undesirable from a number of standpoints including but not limited to the time and cost of installation each time that the rig has to be moved; and in the past such installation has involved the utilization of cables or guidewires anchored in the ground to stabilize the derrick.

Accordingly, there is a need for a portable workover rig which does not require cables or guidewires to support or anchor the derrick and to provide for a derrick and substructure which is completely hydraulic and can be advanced on skids between wellheads without pivoting or disassembling the derrick or other parts of the rig and can be utilized on land as well as off-shore. Further, it is desirable to construct the derrick in such a way as to facilitate mechanical side-loading and unloading of pipe from and to raised pipe rack sections at the base of the derrick without necessity of threading or loading manually upward and downward through the base of the derrick.

SUMMARY

It is therefore an object to provide for a novel and improved rig which is conformable for use in servicing wells which are located on land or offshore in a reliable and efficient manner.

Another object is to provide for a novel and improved portable workover rig which is completely fluid-actuated, is extremely stable and does not require the use of guidewires or cables to anchor to the ground.

A further object is to provide for a novel and improved workover rig which includes a hollow base structure containing the necessary pumps and reservoirs for hydraulic actuation while at the same time greatly stabilizing the entire structure; and further wherein the entire rig including the derrick and base structure can be advanced between wells without disassembly of any of the rig structure.

Still another object and feature is to provide for a novel and improved derrick which is mounted on a hollow base structure and facilitates assembly and disassembly of the pipe sections to be lowered into or lifted out of the well with a minimum of labor and equipment required.

The above and other advantages and features will become more readily appreciated and understood from a consideration of the following detailed description of different embodiments when take together with the accompanying drawings in which:

DETAILED DESCRIPTION OF FIRST EMBODIMENT

Figure 1:
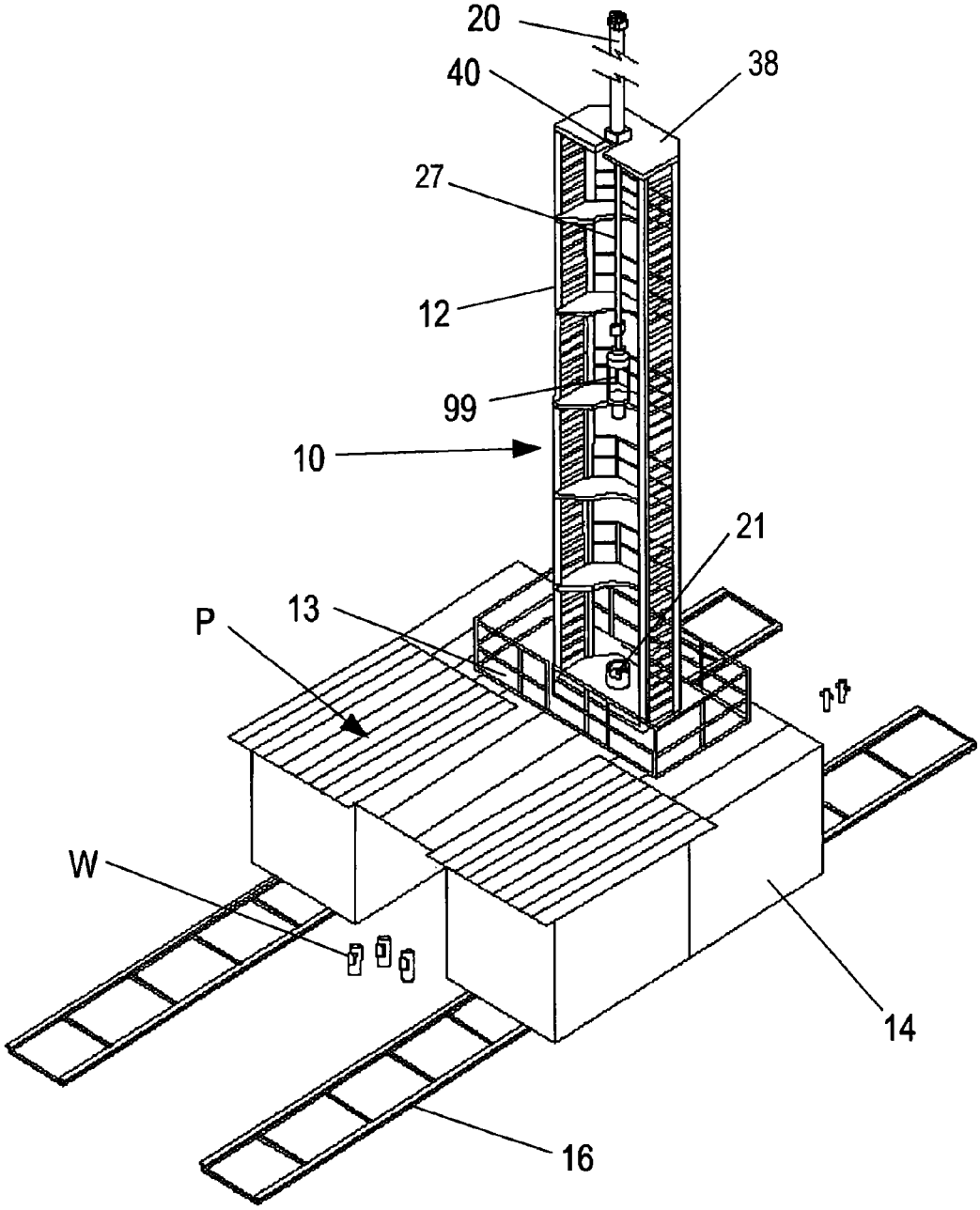
FIG. 1 is a perspective view of one embodiment of workover rig.

In a first embodiment, as shown in FIGS. 1 to 25, a workover rig 10 is broadly comprised of a derrick 12 mounted on a work floor 13 above a base structure made up of one or more housings 14 adapted to be mounted on elongated skids or guideways 16. The guideways 16 are arranged in pairs to flank one or more rows of wellheads represented at W in FIGS. 1 and 5. As a setting for the embodiment shown, the wellheads W may be for gas wells in which directional drilling has enabled the wellheads W to be spaced very short distances apart, such as, on the order of 3 to 6 feet. Fluid-actuated, double-acting cylinders 62 are mounted behind the base structure housings 14 on each pair of skids 16 for the purpose of advancing the rig 10 along the row or rows of wellheads W. Standard snub cylinders, illustrated in FIGS. 26 and 27 and designated by the reference letter S', are also positioned on the work floor 13 and hydraulically controlled through a main control panel to be hereinafter described.

Figure 12:
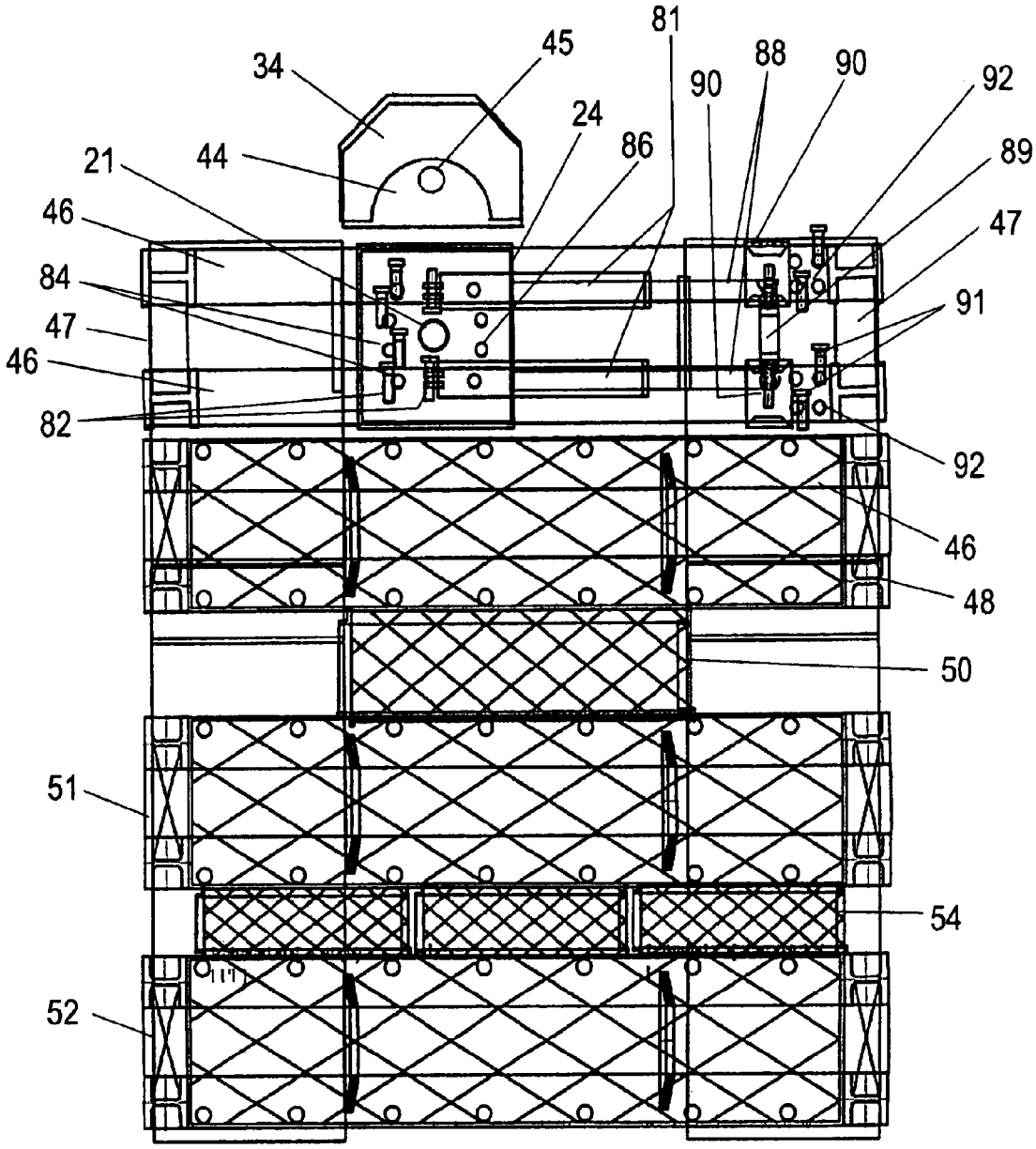
FIG. 12 is an exploded view of the base of the derrick at one end of the derrick slide plate on the work floor.

As best shown in FIG. 12, the derrick 12 supports a main lift cylinder 20 mounted over a center bore 21 at one end of a work floor or platform 13, and lateral adjustment cylinders 81 are engageable with a slidable derrick plate 24 to accurately align the main lift cylinder 20 on the derrick 12 over the well to be serviced or completed.

Figure 2:
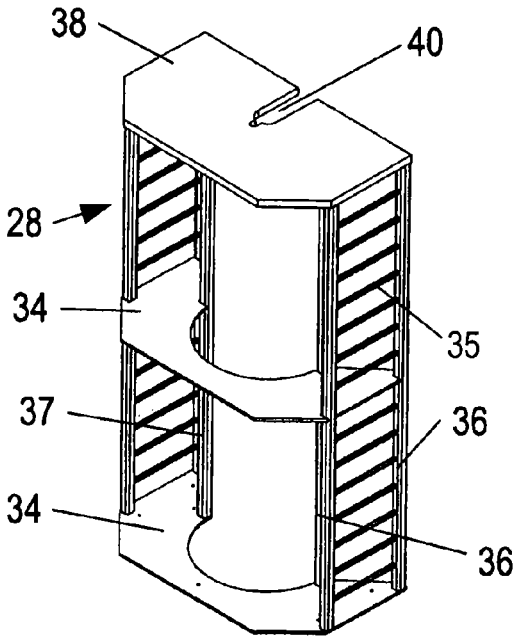
FIG. 2 is a perspective view of the top section of the derrick.
Figure 3:
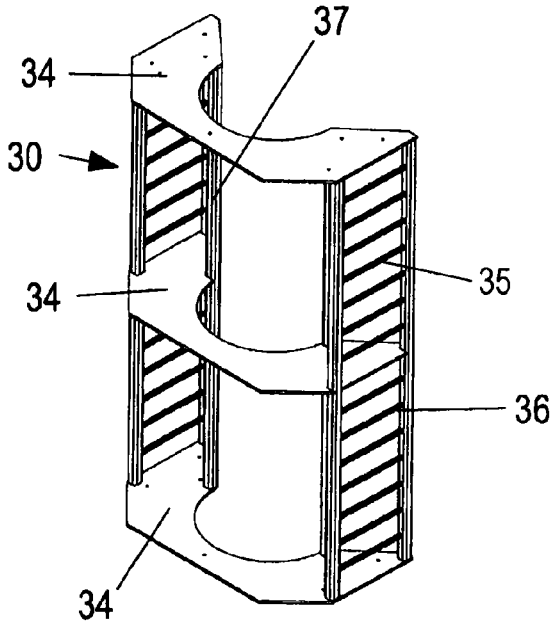
FIG. 3 is a perspective view of the middle section of the derrick.
Figure 4:
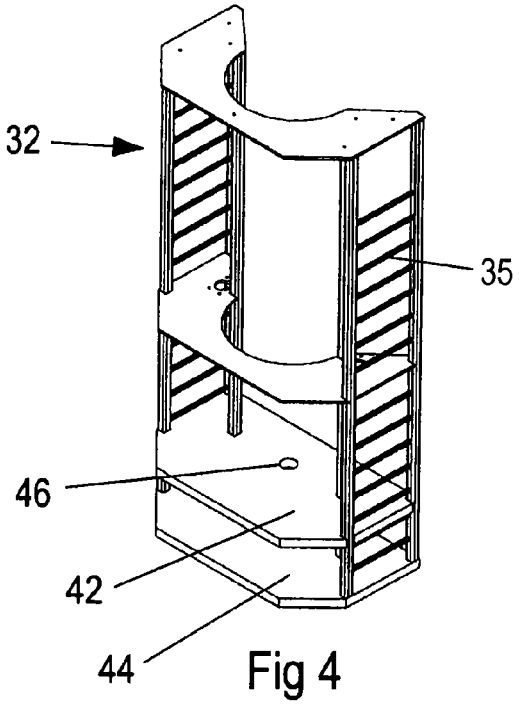
FIG. 4 is a perspective view of the base section of the derrick.
Figure 5:
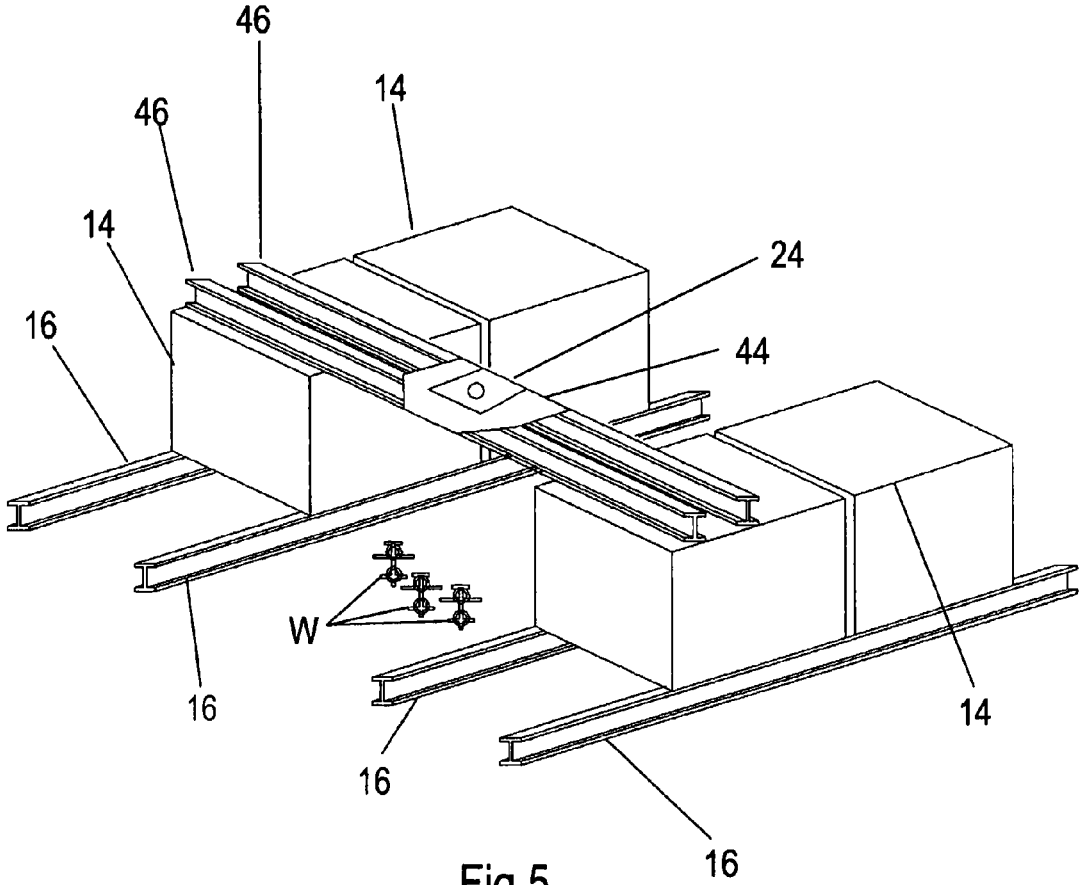
FIG. 5 is a perspective view of the guideways and base support containers on opposite sides of a series of wellheads.

Referring to FIGS. 2 to 4, the derrick 12 is comprised of a top section 28 shown in FIG. 2, a middle section 30 shown in FIG. 3, and a bottom or base section 32 shown in FIG. 4. As best seen from FIG. 1, the sections 28, 30 and 32 are permanently fastened together in end-to-end relation and each is comprised of generally U-shaped gusset plates 34 in vertically spaced relation to one another and joined at opposite edges to vertical tubes 36 having ladders defined by metal rungs 35 therebetween and inner spaced vertical tubes 37 on inner side edges of the plates 34. The top section 28 includes a solid top plate 38 with a notch 40 for mounting of the upper end of the lift cylinder 20. The intermediate or middle section 30 is made up of three gusset plates 34 mounted at spaced intervals between the square tubing 36 and 37, and the base section 32 has upper and lower spaced gusset plates 42 and 44 with center openings 46 for extension of a piston rod 27 at the lower end of the lift cylinder 20. When the sections 28, 30 and 32 are joined together, the U-shaped gusset plates 34 are so aligned as to form an open or recessed front along one side of the substantial length of the derrick so that the lift cylinder 20 is accessible for side-loading and stringing standard pipe sections P together that are to be lowered into the well or subsequently raised or lifted from the well in a manner to be described. The base plate 44 of the derrick is mounted on the derrick slide plate 24, as shown in FIG. 13, to enable lateral adjustment of the derrick 12 by means of the cylinders 22 as earlier described.

FIGS. 11 to 14 illustrate the work floor 13 in more detail and its mounting on the base housing containers 14. The derrick slide plate 24 with a center bore 45, which is shown in exploded form in FIG. 12, is mounted on main crossbeams 46 which are joined together at opposite ends by I-beams 47. The derrick slide plate 24 is slidable along the crossbeams 46 on a low-friction insert plate 25 and of a type similar to that to be described with respect to the skid mount. A generally rectangular catwalk 48 is mounted on the crossbeams 46 as shown and traverses the entire width of the work floor 13 in overlying relation to the base housing members 14. Grating spacer 50 is interposed between the catwalk 48 and pipe rack sections 51 and 52, and the sections 51 and 52 are joined together by another grating spacer 54 to support the pipe sections P which are stacked on the sections 51 and 52.

Figure 13:
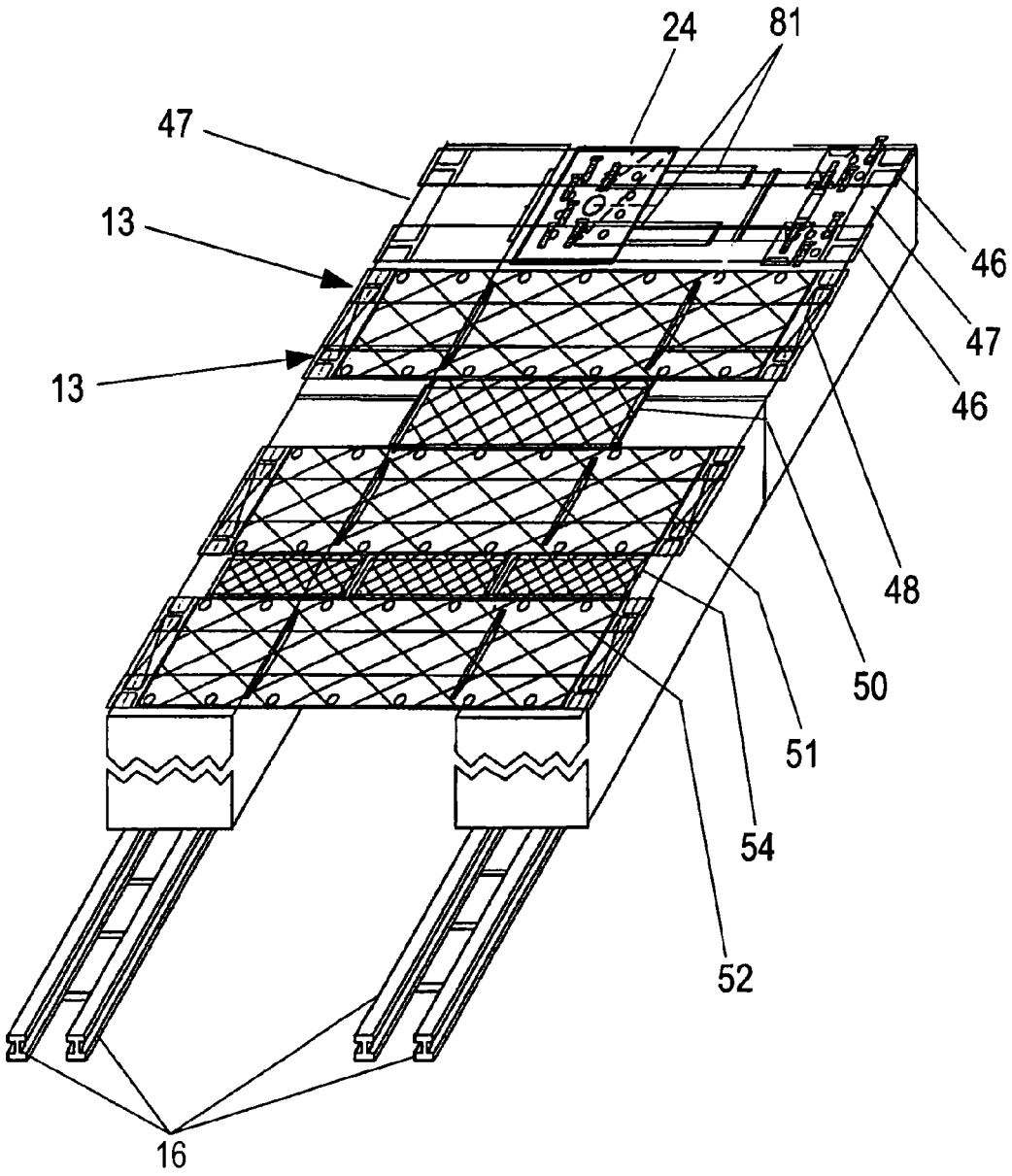
FIG. 13 is a perspective view of the work floor in relation to the base structure.

FIG. 13 illustrates the catwalk 48 and grating spacer assembly mounted on the base structure as represented by the rectangular housing members 14. In addition to the crossbeams 46 referred to earlier, upper beams 49 extend along the entire length of the base structure and securely anchor the upper work floor 13 hereinabove described to the housing members 14. In the embodiment herein shown, the housing members 14 are made up of large shipping containers on the order of 8 feet wide by 20 feet long. As shown in FIGS. 5 to 10, the shipping containers 14 are of elongated, rectangular configuration and each pair is mounted in end-to-end relation to one another with a grade bolt 50 between adjoining ends of the beams 49 to interconnect each pair of containers 14 into flush, aligned relation to one another. The skids 16 are firmly anchored in the ground in spaced parallel relation to one another and each pair of skids 16 extends beneath the inboard and outboard undersurfaces of the containers 14, as best seen from FIG. 8. Further, each pair of skids 16 is rigidly interconnected by crosstube members 17 at spaced intervals along the entire length of the skids 16.

Figure 6:
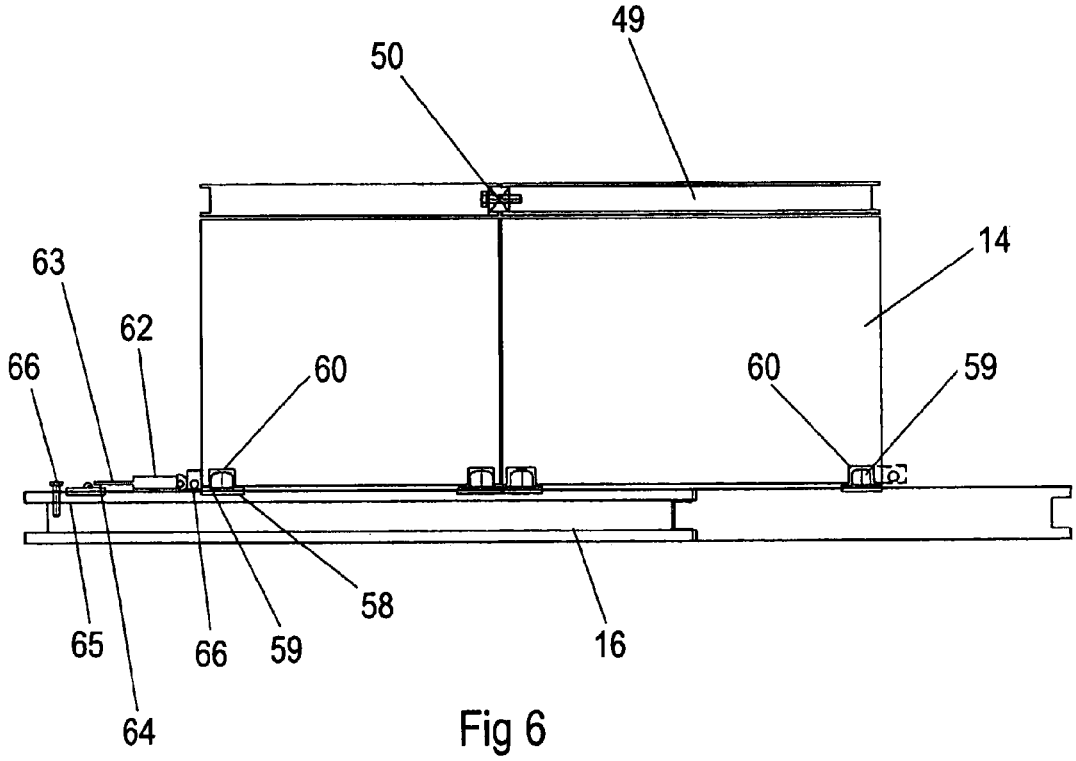
FIG. 6 is an elevational view of the base support structure shown in FIG. 5.
Figure 7:
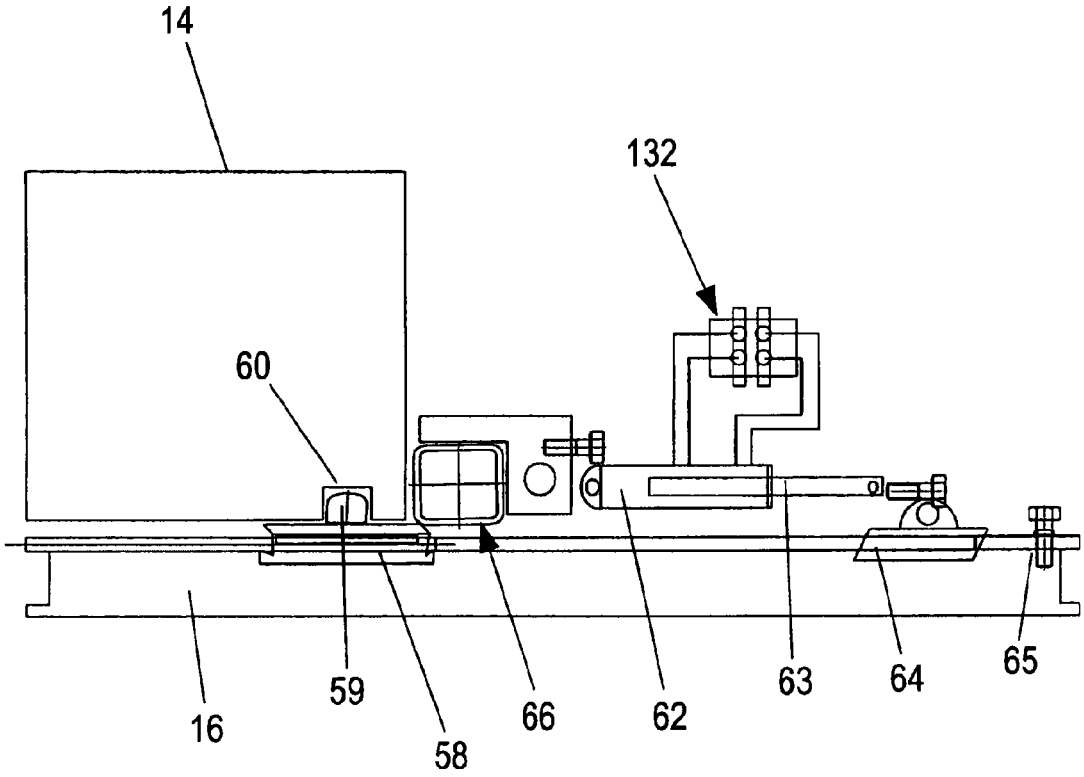
FIG. 7 is a view in more detail of one of the guideways with the hydraulically activated pusher for advancing the base structure along a guideway.
Figure 8:
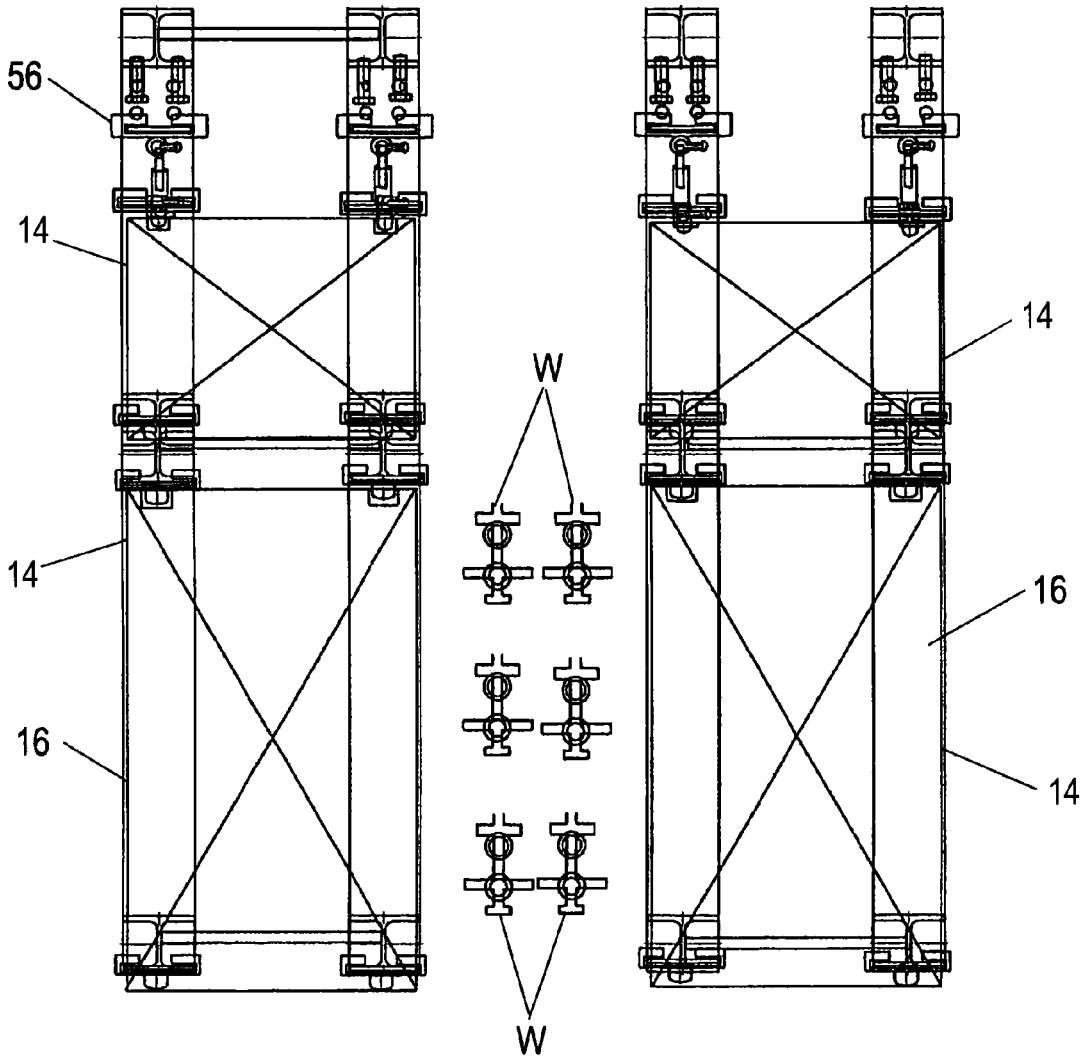
FIG. 8 is a plan view of the base support structure for the rig.
Figure 9:
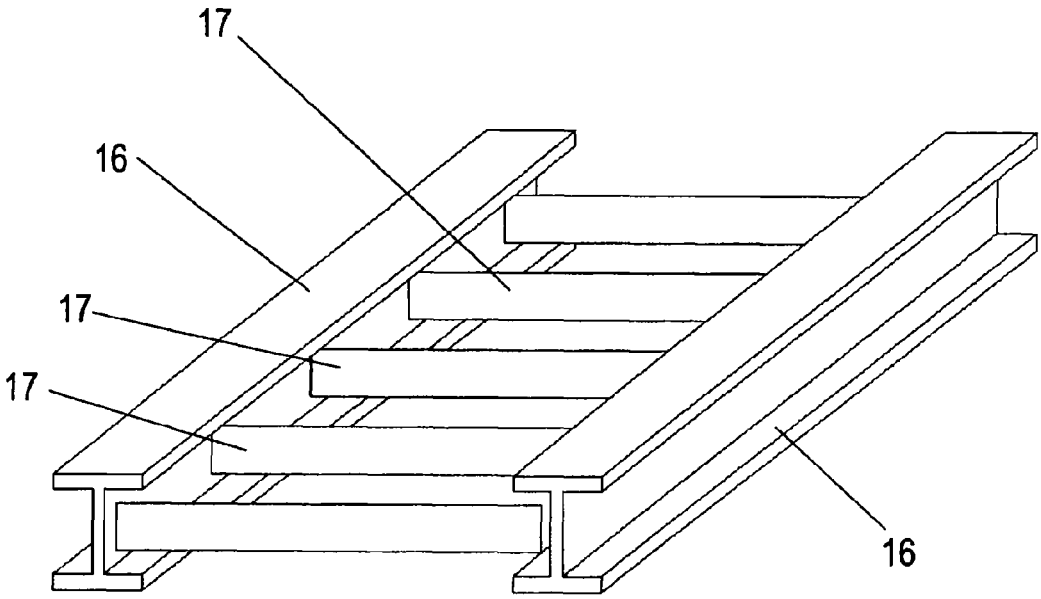
FIG. 9 is a fragmentary perspective view of the pair of the guideways on one side of the base support structure.
Figure 10:
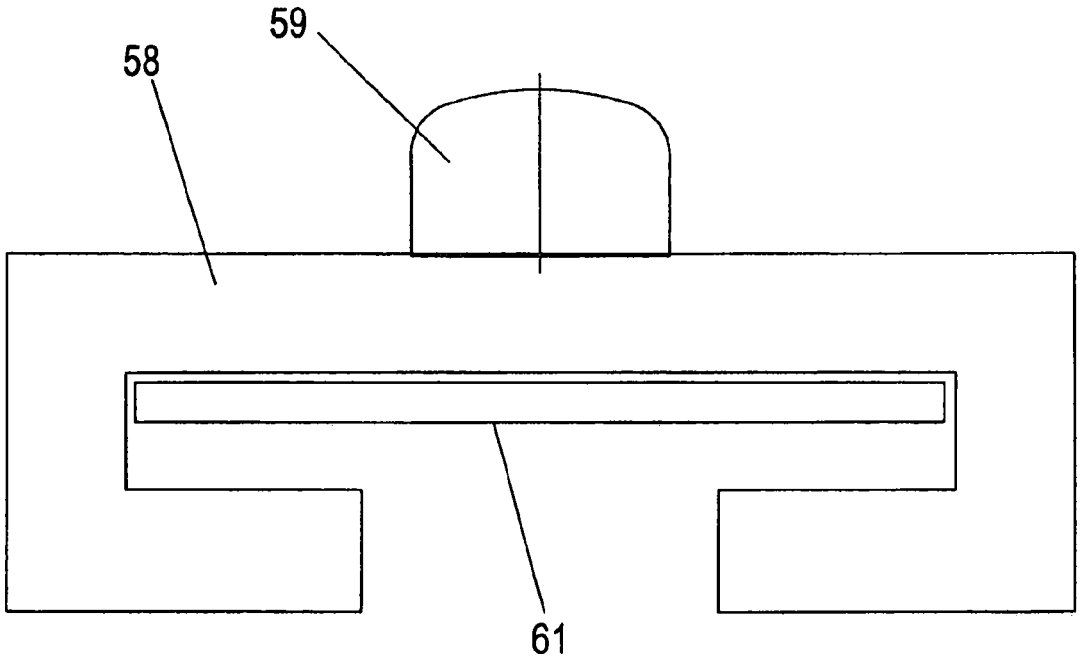
FIG. 10 is an end view of one of the corner supports used for advancing the base structure along the guideways.
Figure 11:
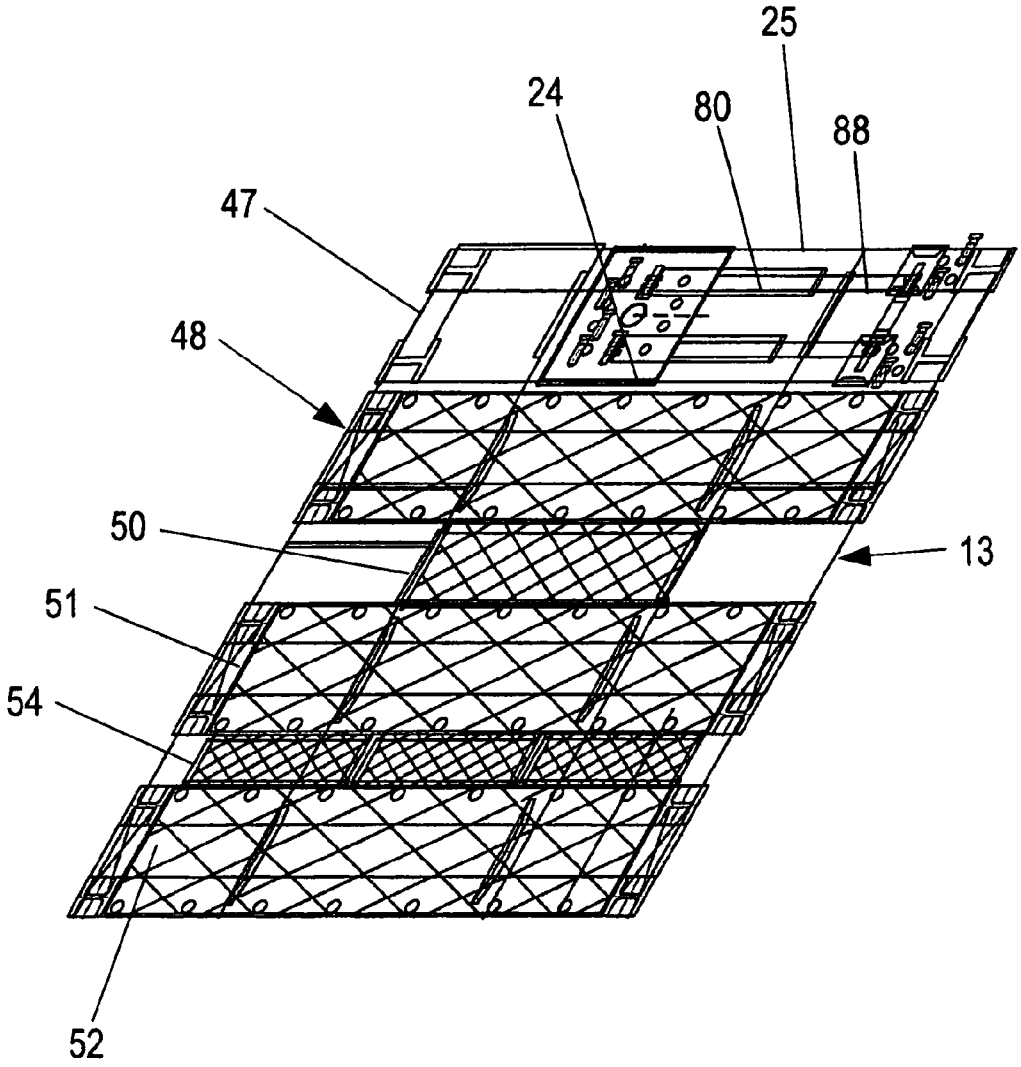
FIG. 11 is a perspective view of the entire work floor mounted on the base structure.

In order to advance the housing members or containers 14 along the skids 16, as shown in FIGS. 6, 7 and 10, low-friction slide members 58 each include an upper guide plate or rod 59 inserted into a recess 60 in the undersurface of the front and rear corner of each of the housing members 14 so that the entire weight of the housing members 14 is applied through the low friction slide members 58 to the skids 16. Low-friction plastic insert plates 61, as best seen from FIG. 10, are positioned between each low friction slide member and skid to enable the entire rig to slide easily along the guideways or skids 16 with a minimum of friction. A double-acting cylinder 62 includes a piston rod 63 bearing against a stop 64 which is adjustably positioned on the skid by an adjustment bolt 66, and the opposite end of the cylinder 62 is affixed to a pusher 66 in direct proximity to and behind one of the low friction slide members 58. The stops 64 are inserted into one of a series of adjustment openings 65 along the length of each skid 16 and spaced apart a distance corresponding to the maximum length of extension of the cylinder. When fluid under pressure is applied in a direction causing extension of the cylinder 62 away from the stop 64, the housing members 14 will be advanced a distance corresponding to the axial movement of the cylinder 62, bearing in mind that the four cylinders 62 will be activated in unison behind the housing members to advance them along the skids 16. Also, the housing members 14 will be advanced incrementally by successively advancing and retracting the cylinders 62 and moving the stops 64 and 66 to the next adjustment opening 65.

Figure 14:
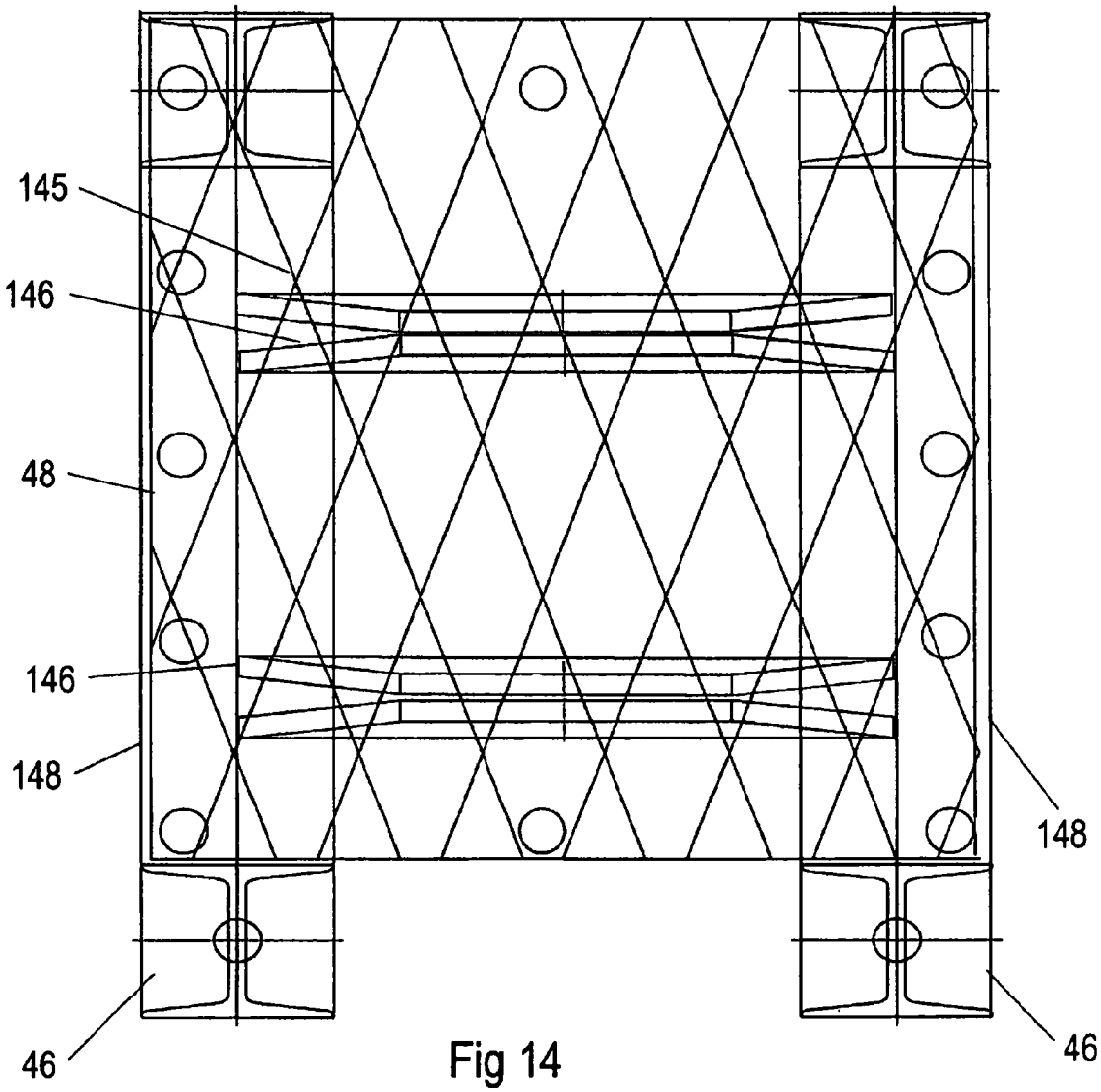
FIG. 14 is a somewhat schematic fragmentary view of the catwalk.
Figure 15:
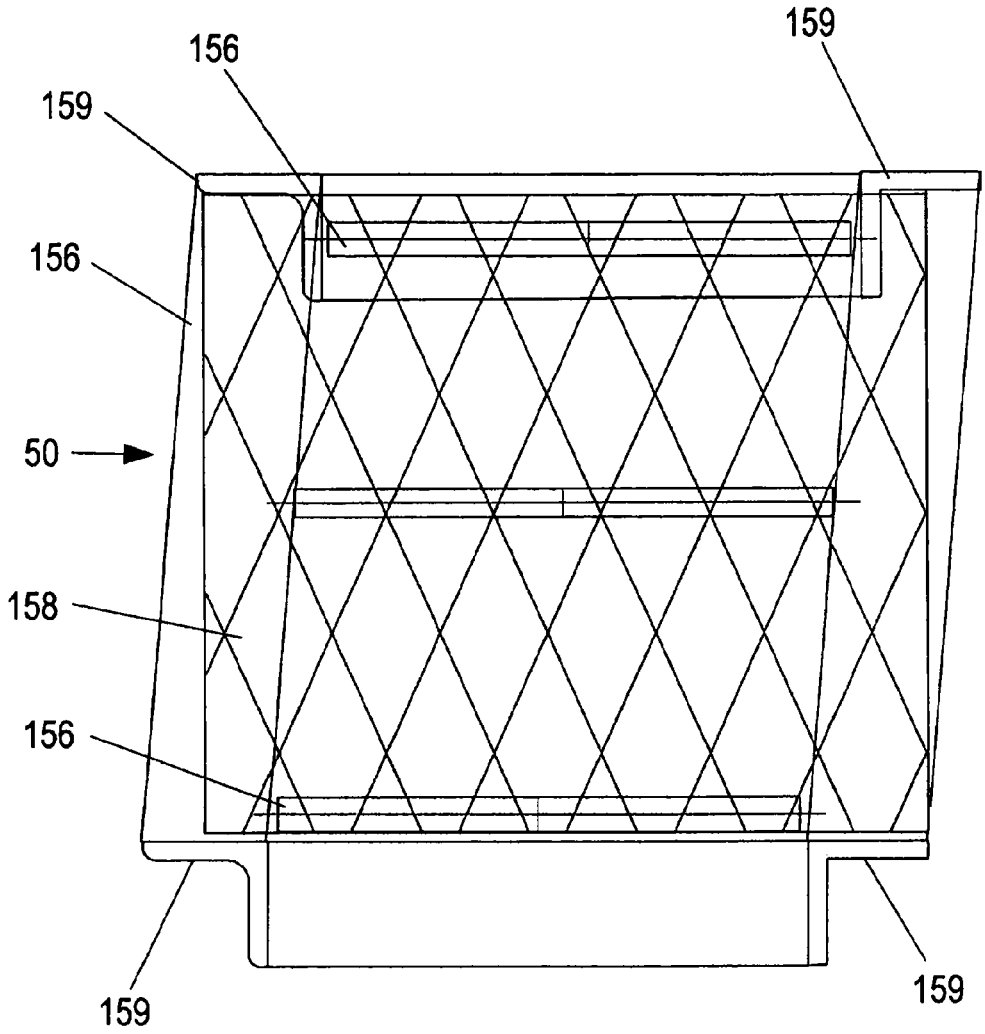
FIG. 15 is a top plan view in detail of one of the grating spacers.
Figure 16:
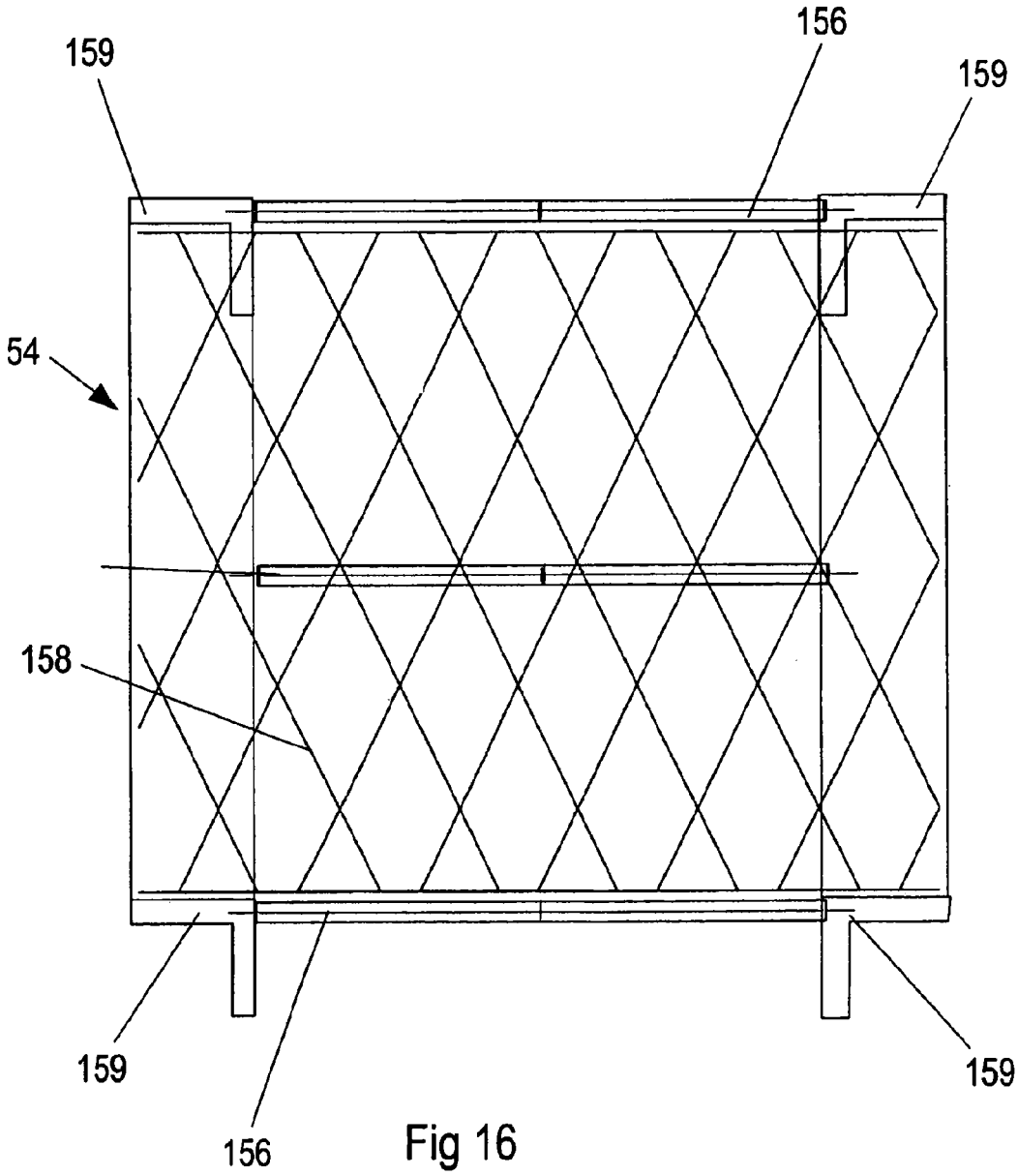
FIG. 16 a plan view in detail of another one of the grating support spacers.

FIGS. 14 to 19 are detailed views of the catwalk 48 and grating spacers 50 and 54, the grating spacers 50 extending between the catwalk 48 and a pipe rack section 51. The catwalk, as illustrated in FIG. 14, is comprised of grating 145 supported on gusset I-beams 146 between rails 148 extending length-wise on opposite sides of the catwalk, and the catwalk 48 is positioned between the crossbeams 46 and the first grating spacer 50. There are three grating spacers 54 in end-to-end relation to one another between the pipe rack sections 51 and 52. The grating support spacers 50 and 54 are correspondingly made up of two-inch square tubing support members 156 underlying a grate 158 and joined to angle irons 159 at the four corners of the grate 158.

Figure 17:
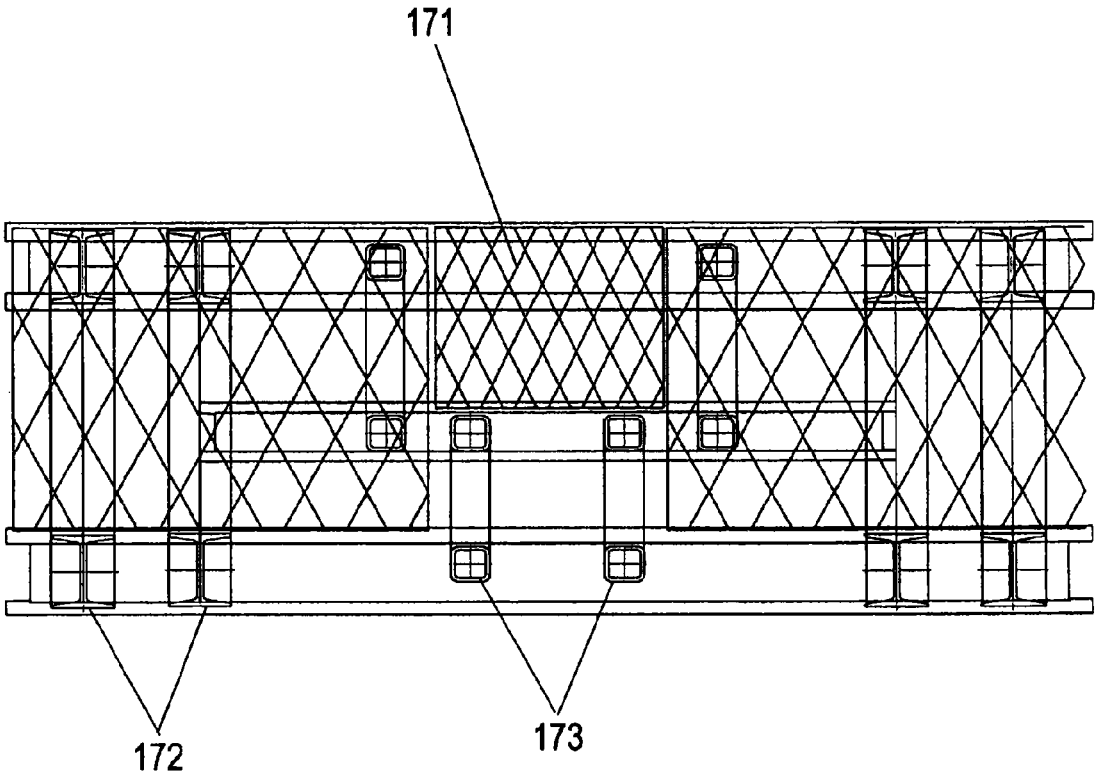
FIG. 17 is a top plan view of one of the pipe rack sections.
Figure 18:
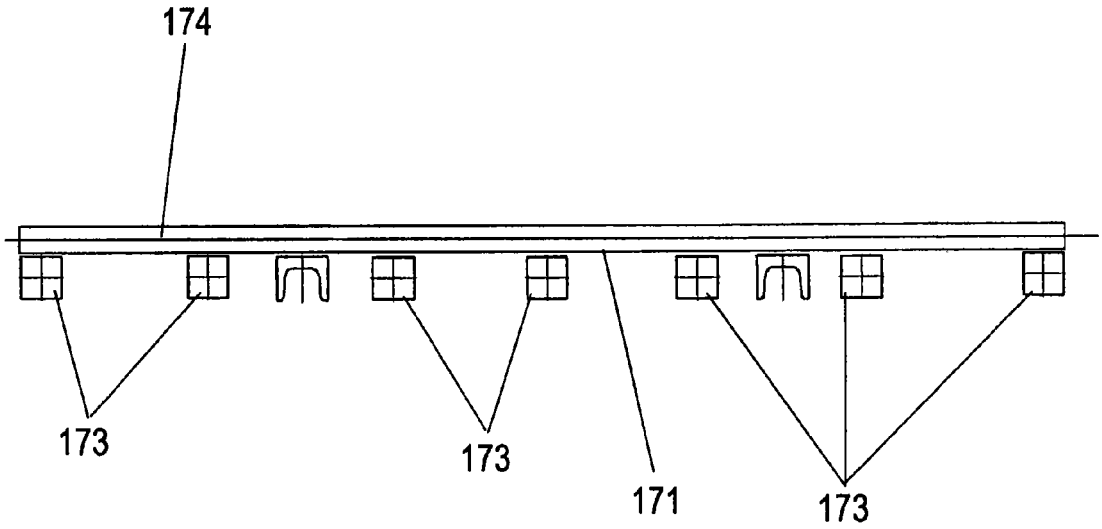
FIG. 18 is an end view of the pipe rack section shown in FIG. 17.
Figure 19:
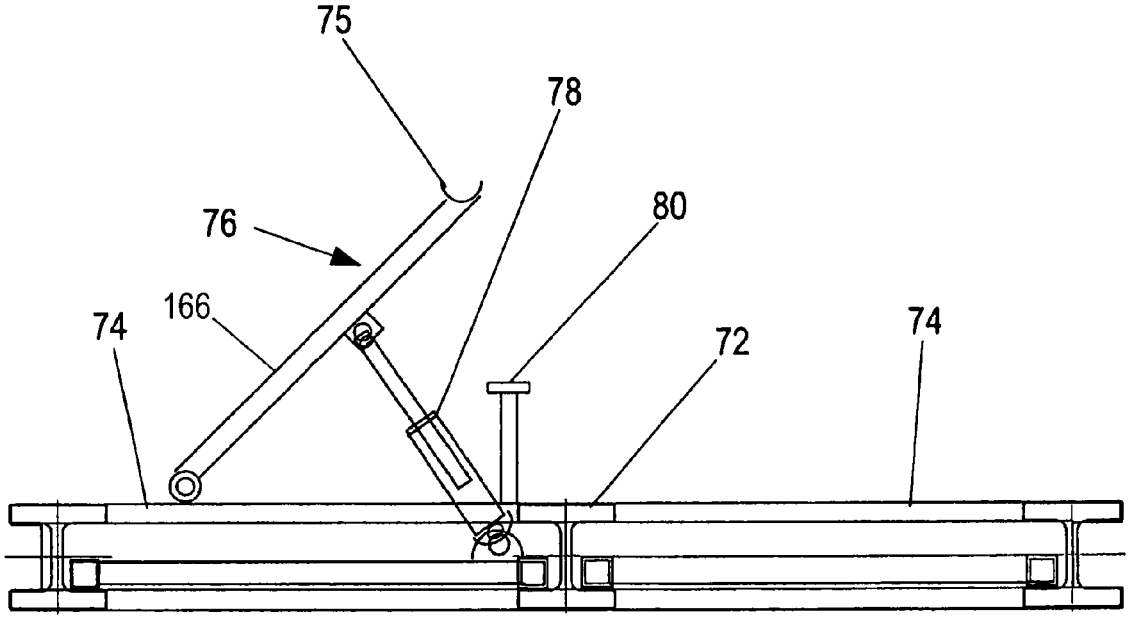
FIG. 19 is a side view of one of the pipe racks shown in FIG. 17 and illustrating a lift bracket for lifting each of the pipe sections along with a lift stop support.

The pipe rack sections 51 and 52 shown in FIGS. 17 to 19 overly portions of the catwalk 48 and, as shown in FIGS. 1 and 13, extend along both sides of the derrick 12 so that the pipe sections P may extend lengthwise of the catwalks. Both sections correspondingly include a rectangular grating 161 which is reinforced by I-beams 172 and square tubes 173 across the undersurface of the grating 161 as illustrated. Also, a flat plate 174 is mounted on the grating 171, as best seen from FIG. 18; and FIG. 19 illustrates the pipe lift slot 75 on the lift bracket 76 which is pivotally mounted on the plate 74 on each pipe rack and controlled by a double-acting cylinder 78 to lift and lower each length of pipe. One of the I-beams 72 is centered between opposite sides of each pipe rack section, and a lift stop support 80 extends upwardly from the plate 74 to limit downward movement of the lift bracket 76.

The derrick 12 is mounted at one end of the work floor 13 on the derrick slide plate 24 with the generally U-shaped open front side of the derrick 12 facing the pipe racks 51 and 52, and the cylinder 20 is aligned vertically with respect to the center bore 21 over the wellhead W. Although FIG. 12 illustrates the base 44 of the derrick in exploded form, it is centered on the derrick slide plate 24 and has its center opening 45 aligned directly over the center bore 21. In this way, the derrick 12 will follow the shifting of the derrick slide plate 24 in aligning the center bore 21 over the wellhead W to be serviced. Specifically, the derrick slide plate 24 is mounted on low-friction plates 25 and is advanced by the lateral adjustment cylinders 81 in spaced parallel relation to one another on the work floor, the end of the cylinders 81 being anchored by a pair of bolts 82 through a spaced pair of openings in each cylinder 81 which are aligned with two matching openings 84 in the derrick slide plate 24. Additional openings 86 are provided in the derrick slide plate 24 for mounting the base plate 44 of the derrick 12 by suitable fasteners, not shown. Piston rods 88 at the opposite ends of the cylinders 81 are anchored by bolts 89 to base plates 90 so that the cylinders 81 are free to advance and retract the derrick slide plate 24 and the base plate 44 in a lateral direction across the end of the work floor 13. Removable stops 91 are insertable into openings 92 which are at staggered intervals from the side edge of the work floor 13 to shift the path of movement of the derrick slide plate 24 and the base plate 44 with respect to the work floor 13 and the ground in vertically aligning the center bores 21 and 45 over each wellhead W in succession.

Figure 20:
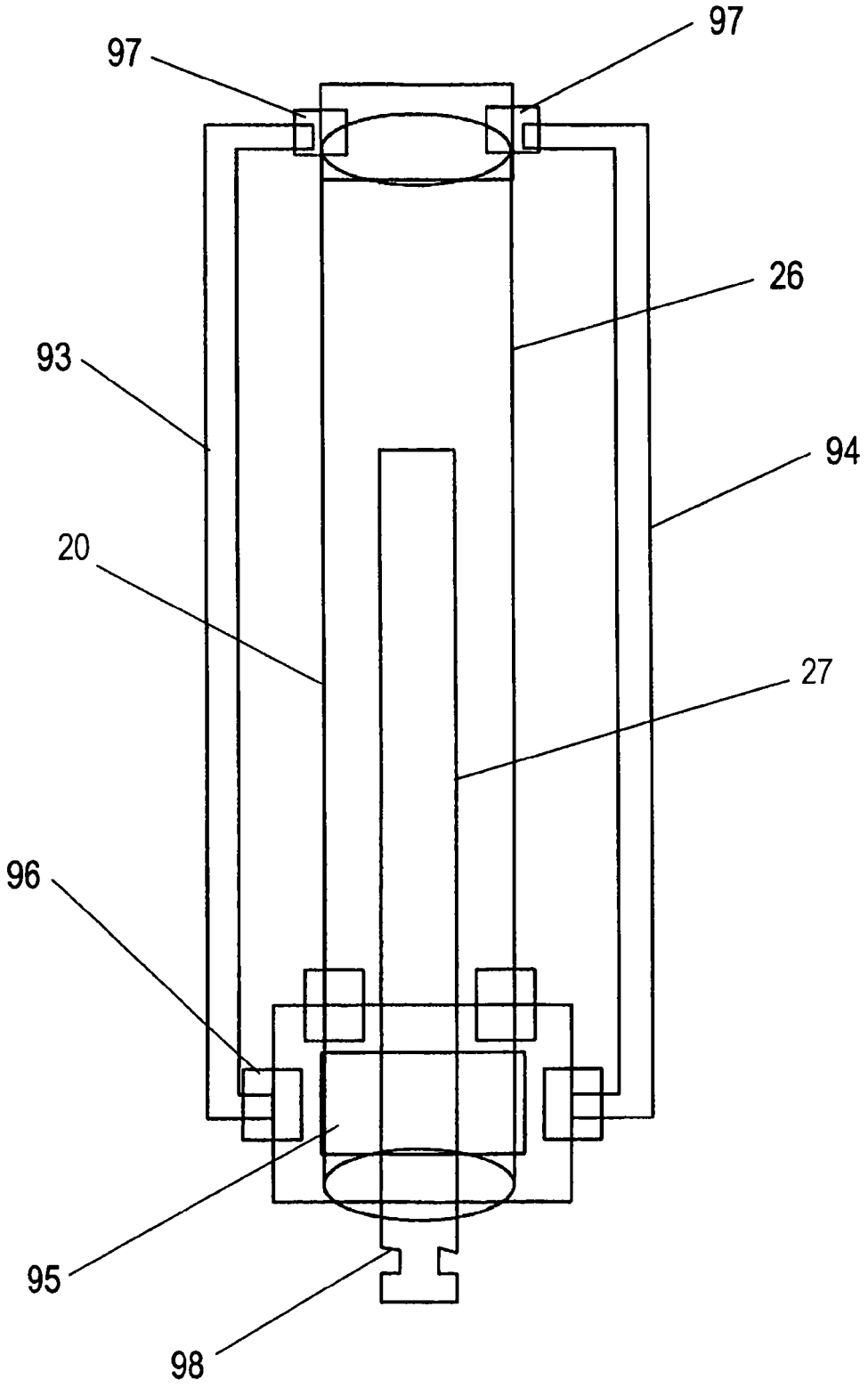
FIG. 20 is a somewhat diagrammatic view of the main lift cylinder.
Figure 22:
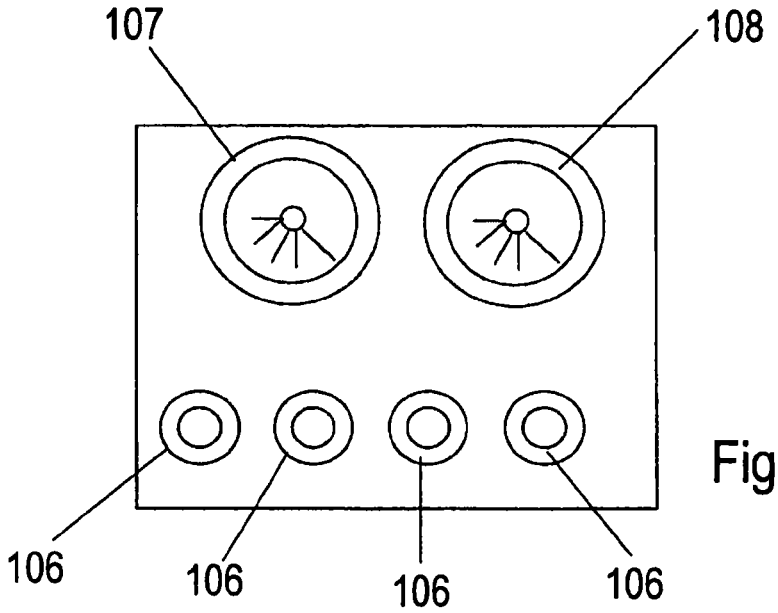
FIG. 22 is another schematic view of the pressure gauges associated with the hydraulic control system.
Figure 21:
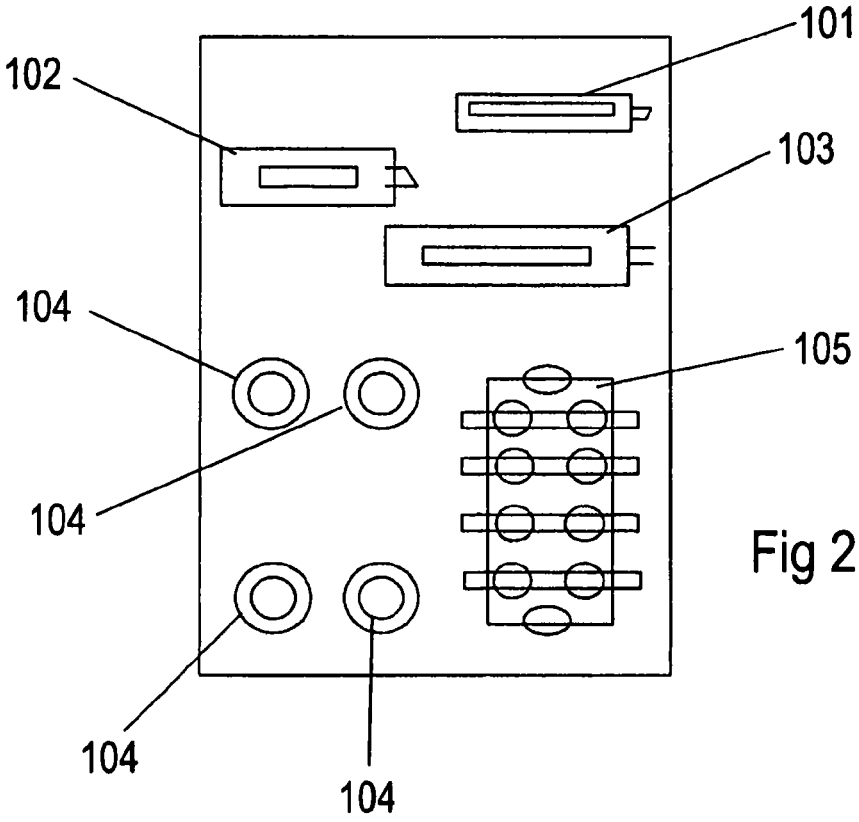
FIG. 21 is a schematic view of the control panel and valves.

There is shown for the purpose of illustration but not limitation in FIGS. 20 to 25 a hydraulic control circuit for operation of the rig and its accessories beginning with one form of lift cylinder in FIG. 20 and continuing with the various controls and control panels in FIGS. 21 to 25 forming part of the hydraulic control circuit. In FIG. 1, the lift cylinder 20 is shown to have its lower end mounted on the top plate 38 of the derrick 12 with the piston rod 27 extending downwardly through the notch 40 in the top plate 38 of the derrick 12. The cylinder 20 is double-acting with flow lines 93 and 94 extending between a lower directional control box 95 via lower ports 96 and upper ports 97 into the upper end of the cylinder. The lower end of the piston rod 27 is notched at 98 for suspension of a standard, hydraulically-actuated elevator 99, as illustrated in FIG. 1. FIG. 21 schematically illustrates a flow control valve 101 for the lift cylinder 20, the valve 102 for a standard rotary table control mounted over of the derrick slide plate 24 and the base plate 44, and pressure relief valves 104 for the lift cylinder 20, rotary table, snub cylinders S' and the conventional upper slips 140 (FIG. 27) and lower slips 141 on the work basket. A four-bank control represented at 105 operates the slips 140 and 141 and pusher cylinders 62 on the derrick 12. FIG. 22 merely illustrates the various pressure gauges on the panel as designated at 106 for the lift cylinder 20, snub cylinders S', slips and rotary table. In addition, a pump gauge 107 is provided for the pump from the reservoir and a weight gauge 108 is provided for sensing the weight of the pipe string.

Figures 23, 24:
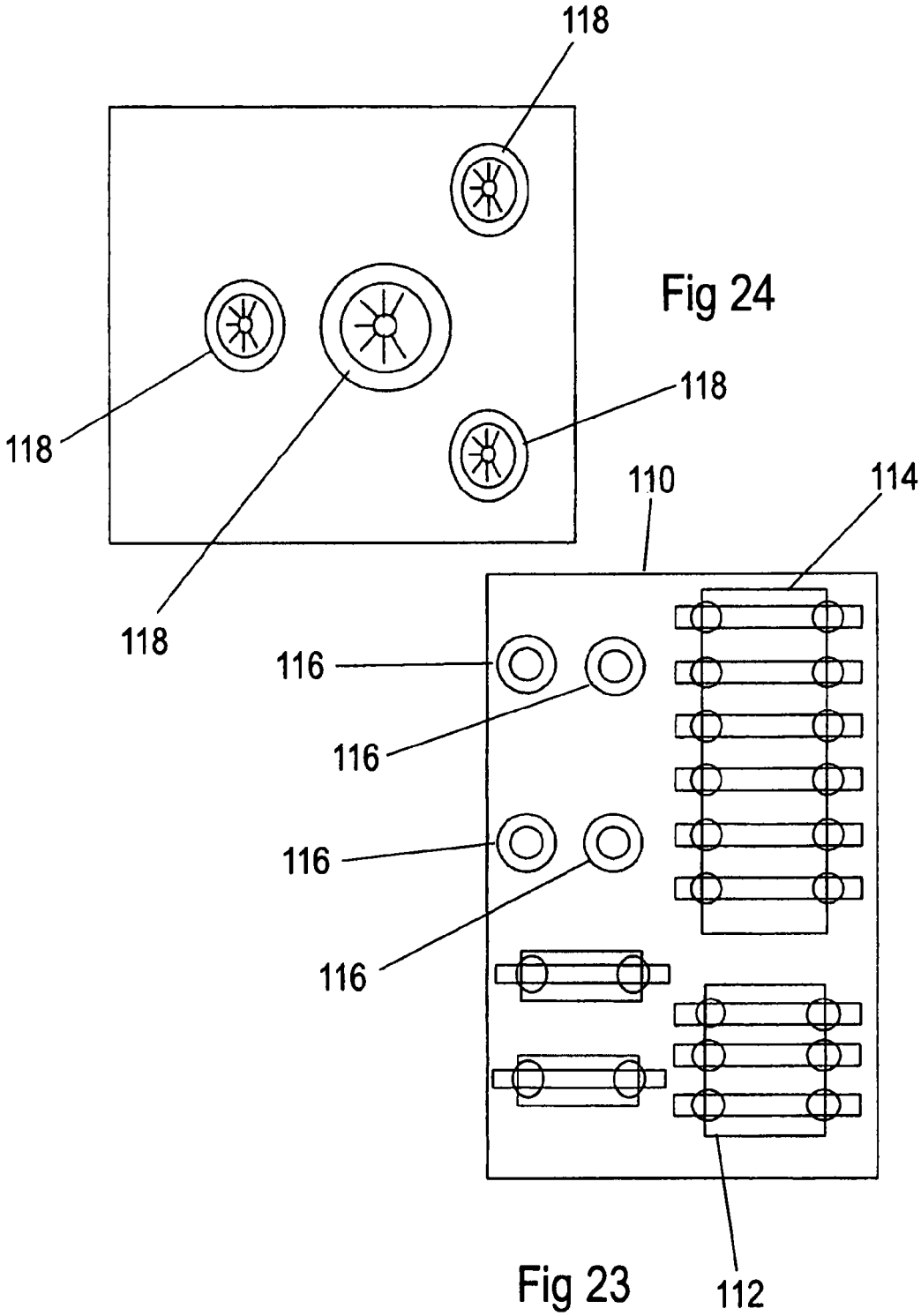
FIG. 23 is a schematic view of an auxiliary control panel.
FIG. 24 is a schematic view of the pressure gauges associated with the auxiliary control panel.

FIG. 23 is another schematic of an auxiliary control panel 110 for use by a second operator and includes a three-bank control 112 for the winch and pipe rack bracket 76. Another set of controls is provided at 114 for the blow-out preventers in the system, and pressure relief valves are represented at 116 for the blow-out preventers. FIG. 24 also represents the various pressure gauges 118 for the pipe rack pressure gauge, blow-out preventer pressure gauge, tong pressure gauge and Hydril pressure gauge.

Figure 25:
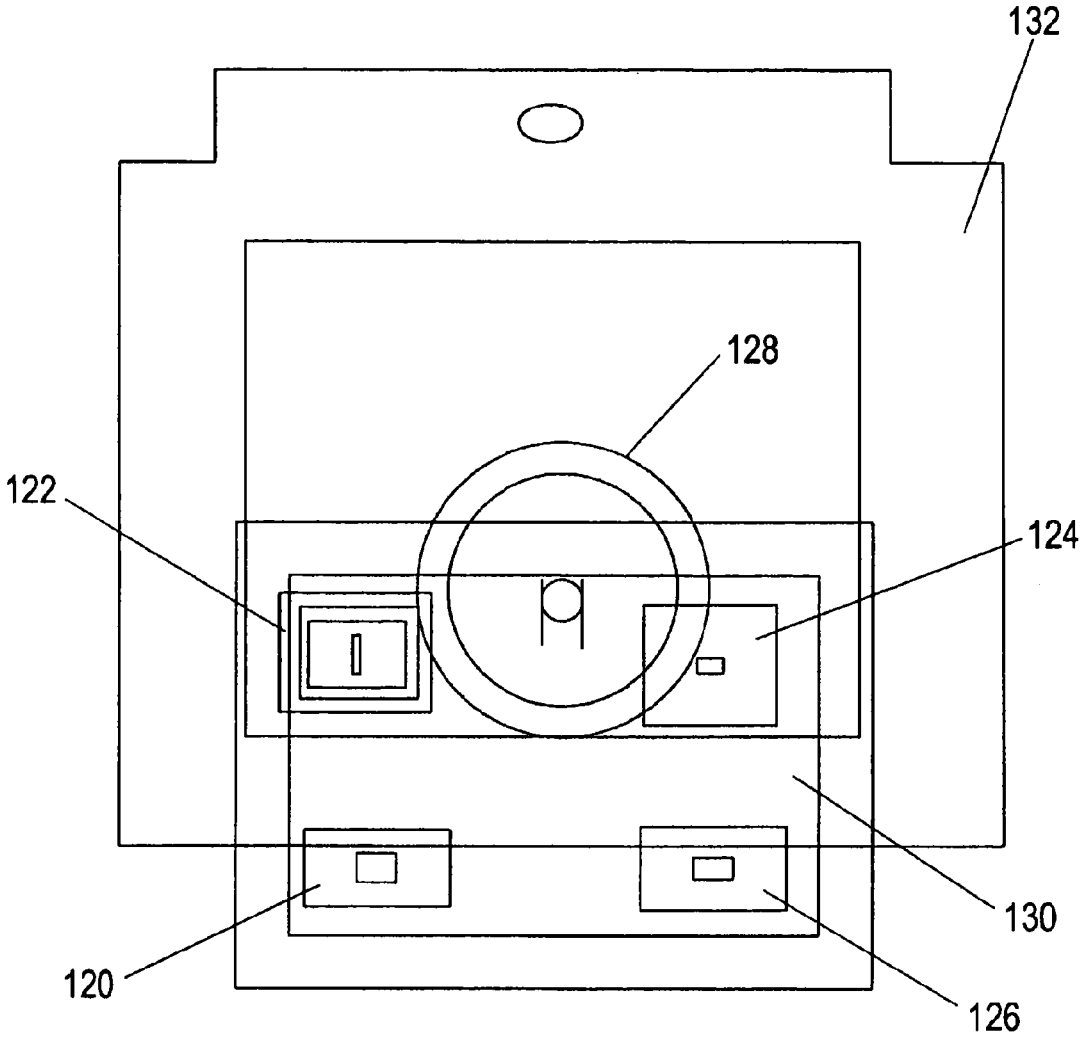
FIG. 25 is a diagrammatic view of the gearbox and hydraulic pumps for operation of the hydraulic components.

FIG. 25 illustrates the engine, gear box and hydraulic pumps including a dual stage pump 120 to operate the main lift cylinder 20, a three-stage pump 122 for the blow-out preventers, catwalk and tongs, another dual stage pump 124 for the elevators 99, rotary drive table and lift cylinder 20, and a dual stage pump 126 for the snub cylinders S' and lift cylinder 20. A flywheel and shaft 128 are mounted on the gear box 130 of the engine 132. The engine, for example, may be a Detroit 8V92 575 horsepower (Detroit Diesel, Detroit, Mich.), and utilizes a three-stage commercial gear pump with three relief valves. The gear box may be a Durst PH 9 (Durst, Shopiere, Wis.). In addition, although not shown, a series of Denison vane pumps (Parker Hannifin HPD, Marysville, Ohio) are provided off of the engine together with 3000 psi relief valves. Another feature of the invention is that the complete engine power pack may be stored in one of the containers 14, the pumps housed in another container 14, the reservoir or tank in one of the containers 14, and the remaining container 14 being utilized as a tool house. In this way, the various engine, pump, and control components will contribute to the weight necessary to stabilize the entire rig and establish a low center of gravity to more than counterbalance the weight of the derrick 12, pipe sections P and lift cylinder 20.

In operation, the pipe sections P are stacked on top of the pipe racks 51 and 52 with their ends in facing relation to the derrick 12. Each pipe section P is raised either manually or with the assistance of the pipe bracket 76 in order to wrap the winch cable, not shown, around the end of the pipe and advance the pipe over to the work basket where it is lined up beneath the elevators 99 on the lift cylinder 20. At this point, the end of each pipe section P is engaged by the elevators 99 and lifted until the pipe P is vertically aligned with the center of the well.

The snub cylinders S' are used only in situations where there is some pressure in the hole, but normally the lift cylinder 20 is used throughout the entire process in lifting and lowering each pipe section into and from the well. The three-stage pump 122 is controlled by the bank of controls on the control panel, one of the pumps having one side that controls the snub cylinder S' when necessary. All three pumps can be activated together as needed to supply the necessary fluid under pressure to the main lift cylinder 20 via the flow control valves 101-103 and the control box 95. One of the pumps is also connected to the rotary drive table. It should be noted that the open or U-shaped front of the derrick 12 enables automated lifting of each pipe section by the cylinder 20 through an angular path of movement from the pipe racks up to the top of the derrick 12 until the pipe section becomes aligned with the wellhead. As the pipe section is then lowered by the lift cylinder 20 it will be engaged by the upper slips 140 (FIG. 27) and threadedly connected to the next lower pipe section in the well. The upper and lower slips 140 and 141 are of standard construction and, for example, may be Cavins slip bowls (Cavins, Singal Hill, CA). At this point, it will be apparent that standard procedure can be followed in successively lowering each pipe section into the well with the aid of the upper and lower slips 140 and 141. Similarly, in lifting each pipe sections from the well, standard procedure may be followed with the use of the slips 140 and 141 but with the additional assistance of the elevator 99 on the lift cylinder 20 for engagement with the upper end of each pipe section and lifting to the height necessary to offload onto the pipe racks.

After each well workover operation is completed, the pusher cylinders are activated to advance the rig along the guideways 16 until the center bore 21 is alongside or aligned with the next wellhead to be serviced. The hydraulic control circuit for the pusher cylinders is represented in FIG. 7 and includes a two-bank control 132 in order to simultaneously activate the cylinders 62 behind the containers 14. The cylinders 62 are push-pull cylinders to advance the entire base structure in either direction along the guideways. A pair of handle controls, not shown, may be mounted on the end of one of the containers 14 to control the flow of fluid from one of the pumps referred to in FIG. 25 to activate the cylinders 62 as referred to earlier. If necessary, the derrick slide plate 24 is activated to adjust the derrick 12 laterally into alignment over the well to be serviced.

DETAILED DESCRIPTION OF SECOND EMBODIMENT

Figure 26:
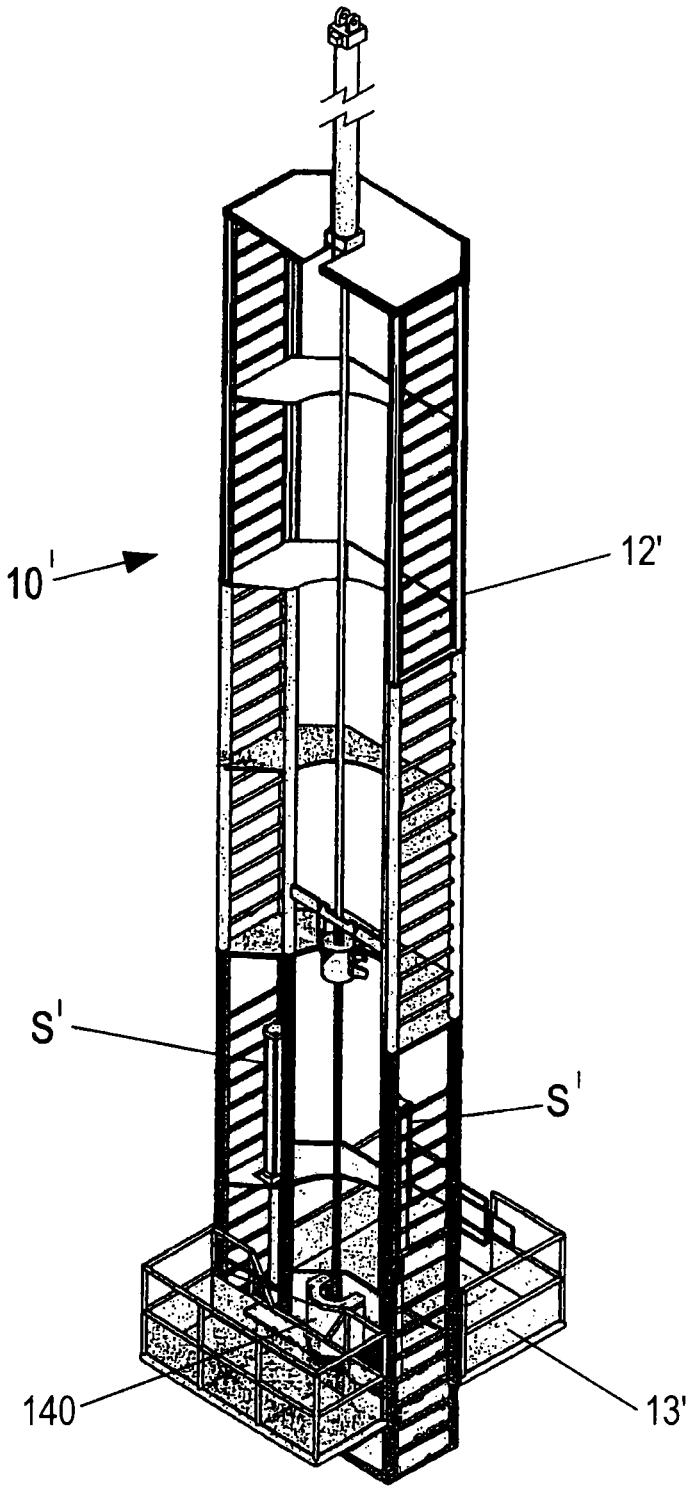
FIG. 26 is a perspective view of an offshore workover rig.
Figure 27:
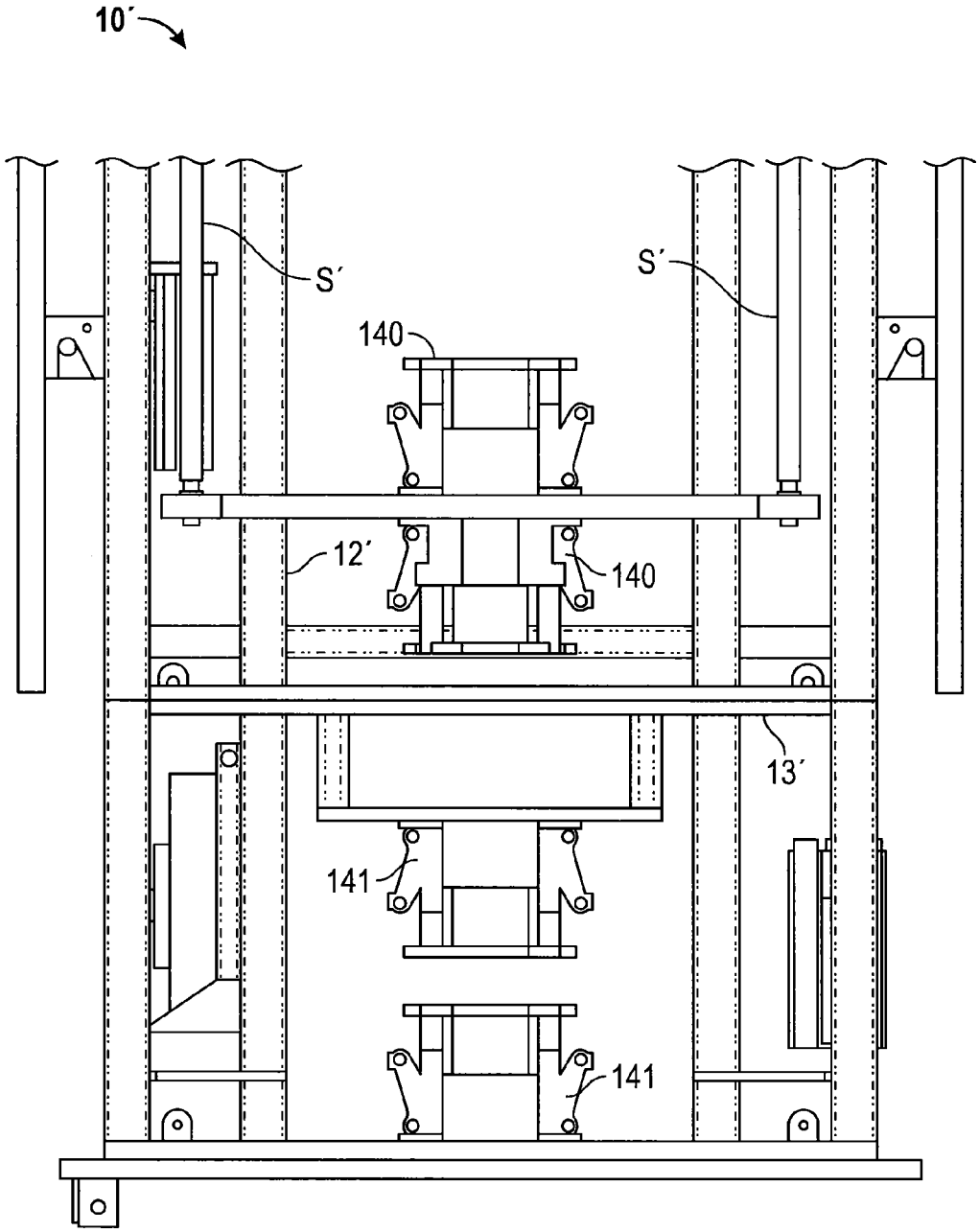
FIG. 27 is an elevational view of a portion of the workover rig of FIG. 26.

An offshore drilling 10' is illustrated in FIG. 26 wherein like parts are correspondingly enumerated with prime numerals. Again, the rig 10' is made up of a derrick 12' mounted on base housing members or containers, not shown, which can be affixed or mounted on the standard offshore drilling platform, not shown, and therefore can utilize the existing positioning controls on the drilling platform to advance the derrick into position for the workover operation. The work floor 13' has the same components including the catwalk, grating spacers, and pipe racks as described in the first embodiment.

It is therefore to be understood that even though numerous characteristics and advantages of the present embodiments have been set forth in the foregoing description, together with the details of the structure and function of the embodiments, the disclosure is illustrative only, and changes may be made within the principles of the embodiments to the full extent indicated by the broad general meaning of the terms in which the appended claims are expressed and reasonable equivalents thereof while preferred forms of the invention are herein set forth and described, the above and other modifications may be made therein without departing from the spirit and scope of the invention as defined by the appended claims and reasonable equivalents thereof.

What is claimed is:

1. A hydraulic workover rig, comprising:

a base structure;

a derrick extending from the base structure and having an upper end;

a single hydraulic lift cylinder including a cylinder and a piston rod, the cylinder having an upper end and a lower end, and the rod having a proximal end and a distal end, the lower end of the cylinder being fixed to the upper end of the derrick and the rod extending from the lower end of the cylinder and being operable between a retracted condition and an extended condition;

a lower slip assembly connected to the base structure, the lower slip assembly being operable between a pipe engaging condition and a pipe release condition;

at least two snub cylinders, each snub cylinder including a cylinder and a rod, the cylinder having an upper end and a lower end, and the rod having a proximal end and a distal end, the rod extending from the lower end of the cylinder and being operable between a retracted condition and an extended condition, the cylinders of the snub cylinders connected to the derrick in a diametrically opposing relationship to one another; and an upper slip assembly connected to the distal end of the rods, the upper slip assembly being operable between a pipe engaging condition and a pipe release condition, wherein the distal end of the piston rod of the lift cylinder is connectable to a pipe string extendable through the upper and lower slip assemblies such that both a lifting force and a snubbing force may be applied simultaneously to the pipe string;

wherein the piston rod of the lift cylinder is axially aligned with the pipe string when the piston rod is connected to the pipe string.

2. The hydraulic workover rig of claim 1, wherein the lift cylinder and the snub cylinders each has a stroke length, and wherein the stroke length of the lift cylinder is greater than the stroke length of the snub cylinders.

* * * * *